United States Patent [19]

Collins

[11] 3,945,358

[45] Mar. 23, 1976

[54] ROTARY INTERNAL COMBUSTION ENGINE WITH CAM TRANSMISSION

[76] Inventor: Brain Stanley Collins, c/o P.O. Box 6, 5 Pycombe Way Balga, Balga 6061, Australia

[22] Filed: Feb. 4, 1974

[21] Appl. No.: 439,586

[30] Foreign Application Priority Data

| | | |
|---|---|---|
| Mar. 20, 1973 | Australia | 2662/73 |
| Feb. 2, 1973 | Australia | 2117/73 |
| Apr. 18, 1973 | Australia | 3056/73 |

[52] U.S. Cl. ..... 123/56 AA; 123/56 C; 123/197 R; 123/55 SR

[51] Int. Cl.[2] ..... F02B 75/26; F02B 75/32

[58] Field of Search ..... 123/50 R, 50 A, 56 AA, 123/55 AA, 56 C, 47 AB, 43 C, 44 E, 197, 55 SR

[56] References Cited

UNITED STATES PATENTS

| | | | |
|---|---|---|---|
| 1,101,599 | 6/1914 | Weisz | 123/50 R |
| 1,314,716 | 9/1919 | Strebler | 123/50 R |
| 1,538,208 | 5/1925 | Nordwick et al. | 123/55 SR |
| 1,603,969 | 10/1926 | Michel | 123/55 AA |
| 1,613,283 | 1/1927 | Michel | 123/55 AA X |
| 1,654,378 | 12/1927 | Marchetti | 123/55 SR |
| 2,477,885 | 8/1949 | McCallion | 123/50 R X |
| 3,572,209 | 3/1971 | Aldridge et al. | 123/55 AA |

*Primary Examiner*—Charles J. Myhre
*Assistant Examiner*—William C. Anderson
*Attorney, Agent, or Firm*—Ulle C. Linton

[57] ABSTRACT

An internal combustion engine comprising a substantially cylindrical casing, a multilobed rotor mounted to rotatably move within said casing, a plurality of substantially cross-sectionally U-shaped combustion chambers slidably mounted in slots or grooves in the casing and projecting inwardly so that the innermost point or face of the chambers are adjacent with the outer face profile of the rotor, the outer profile of said rotor having a circumferential toothed formation thereon, each of said chambers rotatably supporting a gear wheel engaging said toothed formation, ignition means and fuel inlet and exhaust means being provided within the casing for each of the U-shaped chambers, the central longitudinal axis of each combustion chamber being angularly displaced from the radial axis of said casing such that the innermost end of said combustion chamber is displaced in the direction of rotation of said rotor.

9 Claims, 2 Drawing Figures

ROTARY INTERNAL COMBUSTION ENGINE WITH CAM TRANSMISSION

This invention relates to a rotary internal combustion engine.

In one form the invention resides in an internal combustion engine comprising a substantially cylindrical casing, a multilobed rotor mounted to rotatably move within said casing, a plurality of substantially cross-sectionally U-shaped combustion chambers slidably mounted in slots or grooves in the casing and projecting inwardly so that the innermost point or face of the chambers are adjacent with the outer face profile of the rotor, the outer profile of said rotor having a curcumferential toothed formation thereon, each of said chambers rotatably supporting a gear wheel engaging said toothed formation ignition means and fuel inlet and outlet means being provided within the casing for each of the U-shaped chambers, the central longitudinal axis of each combustion chamber being angularly displaced from the radial axis of said casing such that the immermost end of said combustion shamber is displaced in the direction of rotation of said rotor.

Unless otherwise specified the term "rotor" should be taken to include an eccentrically mounted rotor having either rotary, or orbital movement or an oval rotor rotating about a central axis, or the like.

The movement of the rotor within the casing may be one in which the rotor rotates about a central or eccentric axis or one in which the rotor orbits an eccentric axis.

In a preferred form the U-shaped chambers are attached to the rotor by means of bearings, preferably the bearings are fitted to the end of the chamber and are mounted in a channel or groove formed in the rotor.

The invention will be more fully understood in the light of the following description of two specific embodiments of the invention. The following description is made with reference to the accompanying drawings.

Figure 1:
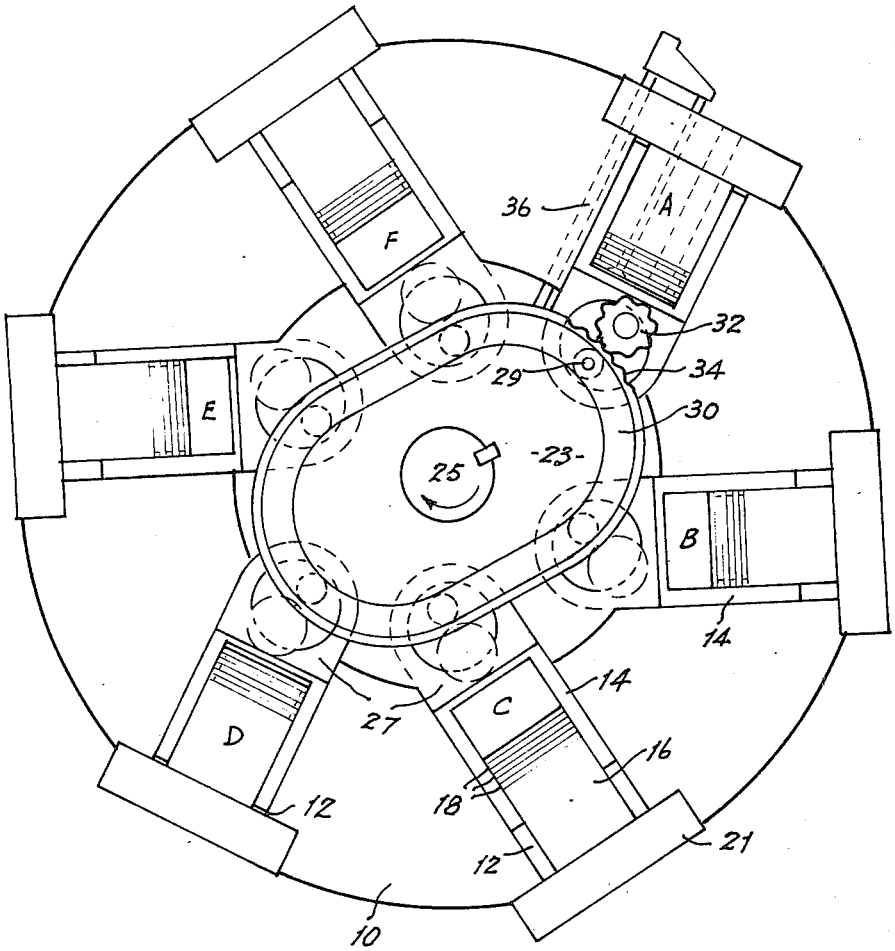
FIG. 1 is a sectional view of an engine according to the invention having a rotating rotor.

The embodiment of FIG. 1 comprises a cylindrical casing 10 having a series of annular slots 12 in its inner peripheral surface. There is mounted in each slot 12 for radial sliding motion therein a cylindrical chamber 14 closed at its innermost end. The portions 16 formed by the slots 12 acting as stationary pistons within the chamber and being provided with sealing means between the walls of the chamber 14 and the portion 16 in the form of sealing rings 18.

The portion 16 may be formed integrally in the casing or may be part of a "head" structure 21 as shown which is removable from the casing. In either case the portion 16 at its innermost end carries inlet and exhaust valves and a sparking plug.

Rotor 23 is substantially oval in shape and is mounted for rotation on central drive shaft 25. Each chamber 14 is provided with an extension piece 27 having a bearing member 29 which is engaged by a milled annular slot 30 in one end of the rotor. The extension 27 is further provided with a gear wheel 32 which engages ring gear 34 to assist in guiding the movement of the rotor in relation to the chamber and absorb some of the load between the two components. The chambers are preferably off set from the radial orientation as shown in order to cause the transfer of motion to be more efficient.

Operation of the valves is via pull rods of the type shown as 36, the pull rods for the inlet and exhaust valves are operated by two suitably shaped cams mounted on the drive shaft.

To illustrate the operation of the engine chamber A shall be taken as being in the state of ignition and the rotor shall be rotating in a clockwise direction. As a result of ignition an inwardly applied force is applied to the chamber which is transmitted through the gear 32. Chamber F is undergoing the power stroke while chamber E is undergoing the exhaust stroke, the end of which stroke is represented by D. Chamber C has completed the intake stroke while chamber B is undergoing the compression stroke prior to ignition. According to this embodiment for each revolution of the drive shaft each chamber fires once.

Figure 2:
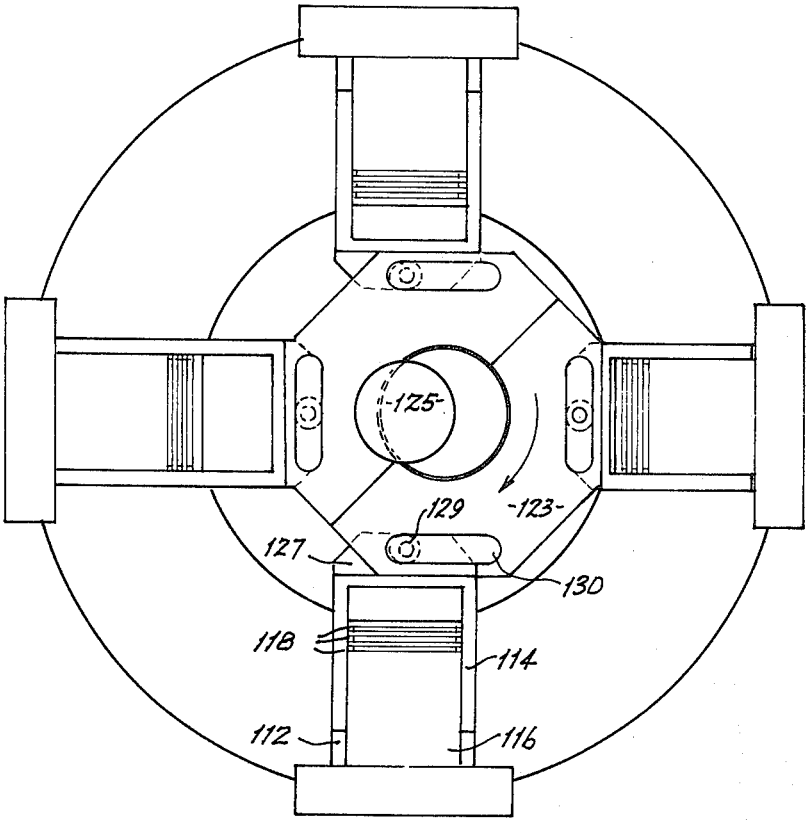
FIG. 2 is a sectional view of an engine according to the invention having an orbital rotor.

The embodiment of FIG. 2 comprises a casing 110 having annular slots 112 equally spaced on its inner surface and having chambers 114 mounted in the slots for radial sliding motion therein. As before the stationary piston 116 may be formed integrally in the casing or formed as shown, integrally in the head 121. A rotor 123 is mounted on shaft 125 such that it executes an orbital motion within the casing. The rotor is polygonal in shape and is provided with milled slots 130 in one end in which bearing members 129 of each chamber are engaged. The bearing members being mounted upon extension pieces 127 of each chamber.

As in the previous embodiment inlet and exhaust valves are provided at the inner end of pistons 116 and are operated by pushrods in rubbing contact with cams driven from the drive shaft 125.

In operation each chamber requires two cycles of the rotor for each ignition. For illustration chamber W shall be taken as undergoing ignition and the movement of the rotor is clockwise. After ignition an inwardly directed force by the chamber is transmitted to the rotor 123 over the contact surface. One complete cycle of the rotor involves the power and exhaust stroke while a further complete cycle involves the intake and compression strokes.

A two cycle system can also be used in both embodiments. While the invention has been described with reference to cylindrical chambers sliding in annular slots it need not be so limited. Each chamber may take the form of an elongated channel member mounted in adjacent longitudinal slots with suitable sealing being provided between the ends of the channels and end plates or the ends of the channels may be closed off. Similarly the chambers may have any suitable shaped cross-sectional configuration.

While the invention has been described in terms of an oval centrally rotating rotor and an orbiting polygonal rotor the invention need not be so limited. It is within the scope of the invention to include any other form of circulating rotor.

The invention while being described in terms of an internal combustion engine having intake valves, exhaust valves, and sparking plugs may also be applied to diesel engines, petrol injected engines, steam engines, compressors, hydraulic motors, hydraulic pump and electric motors and the like.

I claim:

1. An internal combustion engine comprising a substantially cylindrical casing having grooves therein, a multilobed rotor being rotatably mounted within said casing, a plurality of substantially cross-sectionally U-shaped combustion chambers slideably mounted in said grooves in the casing and projecting inwardly so that the innermost point or face of said chambers are adjacent the outer profile of said rotor, the outer profile of said rotor having a circumferential toothed formation thereon, each of said chambers rotatably supporting a gear wheel which is intended to engage and bear upon the toothed formation on the outer profile of said rotor, ignition means and fuel inlet and exhaust means being provided within said casing for each of said U-shaped chambers, the central longitudinal axis of each combustion chamber being angularly displaced from the radial axis of said casing such that the innermost end of said combustion chamber is displaced in the direction of rotation of said rotor.

2. An internal combustion engine as claimed in claim 1 wherein said rotor is provided at one end thereof with at least one slot provided at one end thereof with at least one slot provided adjacent its circumference and each said U-shaped chamber is provided at its inner end with a bearing means adapted to be engaged in said slot to transmit the motion of the rotor to the chamber.

3. An internal combustion engine as claimed in claim 1 wherein said rotor is oval in shape and rotates about a central axis.

4. An internal combustion engine comprising a substantially cylinderical casing having grooves therein, a multilobed rotor being rotatably mounted within said casing, a plurality of substantially cross-sectionally U-shaped combustion chambers slideably mounted in said grooves in said casing and projecting inwardly so that the innermost point or face of said chambers are adjacent with the outer face profile of said rotor, the outer profile of said rotor having a circumferential toothed formation thereon, each of said chambers rotatably supporting a gear wheel which is intended to engage and bear upon the toothed formation on the outer profile of said rotor, ignition means and fuel inlet means and exhaust means being provided within said casing for each of said U-shaped chambers, the central longitudinal axis of each combustion chamber being angularly displaced from the radial axis of said casing such that the innermost end of said combustion chamber is displaced in the direction of rotation of said rotor, said grooves being annular in shape and said U-shaped chambers are cylindrical in shape and are mounted in said grooves such as to permit axial movement of said chambers in said grooves.

5. An internal combustion engine as claimed in claim 4 wherein the upstanding portion defined by the slots and surrounded by the said chamber is provided with sealing means to prevent gas flow between the walls of the upstanding portion and the inner walls of said chamber.

6. An internal combustion engine as claimed in claim 4 wherein the upstanding portion defined by the slots and surrounded by the chamber is provided at its inner end with fuel inlet, exhaust outlet and ignition means communicating with the interior of said chamber.

7. An internal combustion engine as claimed in claim 4 the inner portion defined by the slots and surrounded by the chamber is formed as a separable head portion of the cylindrical casing.

8. An internal combustion engine as claimed in claim 4 wherein said rotor is provided at one end thereof with at least one slot provided adjacent it circumference and each said U-shaped chamber is provided at its inner end with a bearing means adapted to be engaged in said slot to transmit the motion of the rotor to the chamber.

9. An internal combustion engine comprising a substantially cylindrical casing having grooves therein, a polygonal rotor being mounted to move with an orbital motion within said casing, a plurality of substantially cross-sectionally U-shaped combustion chambers slidably mounted in said grooves in said casing and projecting inwardly so that the innermost point or face of said chambers are adjacent with the outer face profile of said rotor, ignition means and fuel inlet and exhaust means being provided within said casing for each of said U-shaped chambers, said rotor having slots therein, said chambers each having a pin slideably mounted in one of said rotor slots, said casing grooves being annular in shape, said U-shaped chambers being cylindrical in shape and being slideably mounted in said casing grooves for allowing radial movement of said chambers in said casing grooves.

* * * * *